US006634573B2

(12) United States Patent
Boesch et al.

(10) Patent No.: US 6,634,573 B2
(45) Date of Patent: Oct. 21, 2003

(54) WATER DISCHARGE DEVICE WITH A HOSE SLIDING IN A CURVED PIPE

(75) Inventors: Paul Boesch, Ebnat-Kappel (CH); Beat Manser, Jona (CH); Daniel Riesen, Bubikon (CH)

(73) Assignee: Weidmann Plastics Technology AG, Rapperswil (CH)

( * ) Notice: Subject to any disclaimer, the term of this patent is extended or adjusted under 35 U.S.C. 154(b) by 0 days.

(21) Appl. No.: 10/151,239

(22) Filed: May 21, 2002

(65) Prior Publication Data

US 2002/0175224 A1 Nov. 28, 2002

(30) Foreign Application Priority Data

May 22, 2001 (EP) ..... 01810506

(51) Int. Cl.[7] ..... A62C 31/00
(52) U.S. Cl. ..... 239/443; 239/448; 239/553.5
(58) Field of Search ..... 239/436, 443–449, 239/553.5; 4/676, 677; 137/801

(56) References Cited

U.S. PATENT DOCUMENTS 4,589,439 A 5/1986 Steingass
5,158,234 A 10/1992 Magnenat et al.
5,744,033 A * 4/1998 Bertrand et al. ..... 239/553.5
6,085,790 A * 7/2000 Humpert et al. ..... 239/447
6,370,713 B2 * 4/2002 Bosio ..... 239/553.5

FOREIGN PATENT DOCUMENTS

DE 3442490 A1 5/1986
GB 2185910 A 8/1987

* cited by examiner

*Primary Examiner*—Michael Mar
*Assistant Examiner*—Dinh Q. Nguyen
(74) *Attorney, Agent, or Firm*—Sughrue Mion, PLLC

(57) ABSTRACT

The water discharge device (faucet) is provided with a pullout spray head (2) that may be pulled down from the curved pipe (3) and which spray head is provided with a discharge mouthpiece (5). A switching valve (8) is arranged within said spray head (2) whereby said switching valve (8) is positioned in a housing (7) that is dimensioned in such a manner that it may be grasped by the user with one hand. Said switching valve (8) may be actuated by an operating lever (6). Said operating lever (6) is a bail (U-shaped lever) that is pivotably mounted on a water-guiding part (24) and which in turn is connected to a switching arrangement (28) mounted in said housing (7) with which a valve member (9) of the diverting valve (28) may be moved in its longitudinal direction during movement of the bail (6). Said bail (6) is arranged in such a manner that it may be operated with the thumb of the hand that is grasping said housing (7). Said valve member (9) may be preferably moved by means of a cam (17) of said switching arrangement (28). The device may be operated ergonomically in a very simple manner.

16 Claims, 2 Drawing Sheets

WATER DISCHARGE DEVICE WITH A HOSE SLIDING IN A CURVED PIPE

BACKGROUND OF THE INVENTION

The invention relates to a water discharge device (faucet) having a hose sliding in a curved pipe and a spray head with a discharge mouthpiece that may be pulled downwardly out of the curved pipe whereby a switching valve arranged on said spray head is positioned in a housing that is dimensioned in such a manner that it may be grasped and operated by the user with one hand, and whereby an operating lever projects to the outside thereof by which said switching valve may be actuated.

A water discharge device of the aforementioned type is known in the art from EP 0 933 136 A. It is a kitchen spray faucet and it can be switched from a center stream discharge to a spray discharge. A switching valve must be switched for this purpose whereby said switching valve has a tappet-shaped valve member that is moveable in its longitudinal direction between two positions. A pivoting lever is mounted on the housing to switch the valve member whereby said pivoting lever is arranged below a flexible push-in membrane. This push-in membrane and said lever project from the back of the housing and it may be operated by the hand that is grasping the spray head. It is essential in such water discharge devices that the type and ways of operation are obvious and may be understood without instructions. The operating lever is not visible in case of the push-in membrane and it is not very clear how such a water discharge device is to be operated and how it is to be switched, in particular.

SUMMARY OF THE INVENTION

It is the object of the invention to provide a device of the aforementioned type that avoids said disadvantages. However, it should still be simple and cost-effective in its production and is should be operationally reliable as well.

The object is achieved in a water discharge device of this type in that the operating lever is a bail (U-shaped lever) that is pivotably mounted and connected to a switching arrangement disposed in the housing with which a valve member of the switching valve may be moved in its longitudinal direction when the bail is pivoted whereby said bail is mounted on the housing and it is designed in such a manner that it may be operated with the thumb of the hand that is grasping the housing. The bail is preferably arranged on the face of the housing and it is projecting upwardly thereof. Such a bail may be comfortably pivoted with the thumb and it may also be readily recognized as an operating device. With the water discharge device of the invention, there is an operation possible that is workable ergonomically in a simple manner without instructions and its operation is thereby self-explanatory.

Should the valve member be slidable by means of a cam of the switching device, as in a development of the invention, then operation is possible with a relatively small pivoting angle. Such a small pivoting angle simplifies the operation of the bail. This pivoting angle is preferably less than 45 degrees. A pivoting angle in the range of approximately 20–25 degrees has been shown to be ideal.

According to a development of the invention, it is proposed that the bail is locked in its two functioning positions. The two positions may then be found very easily and fixed thereby. For example, the switching valve is adjusted in the first locked position for a central stream discharge and in the second locked position for a spray discharge. Preferably, locking is achieved and it is very simple in its construction by means of a catch stop that is attached to a cam and which in turn may lock into a part of the water-guiding part.

BRIEF DESCRIPTION OF THE DRAWINGS

Additional advantageous characteristics are shown in the dependent patent claims, in the subsequent description, and in the drawings.

In the following, an embodiment example of the invention is explained in more detail with the aid of accompanying drawings.

DESCRIPTION OF THE PREFERRED EMBODIMENT

Figure 1:
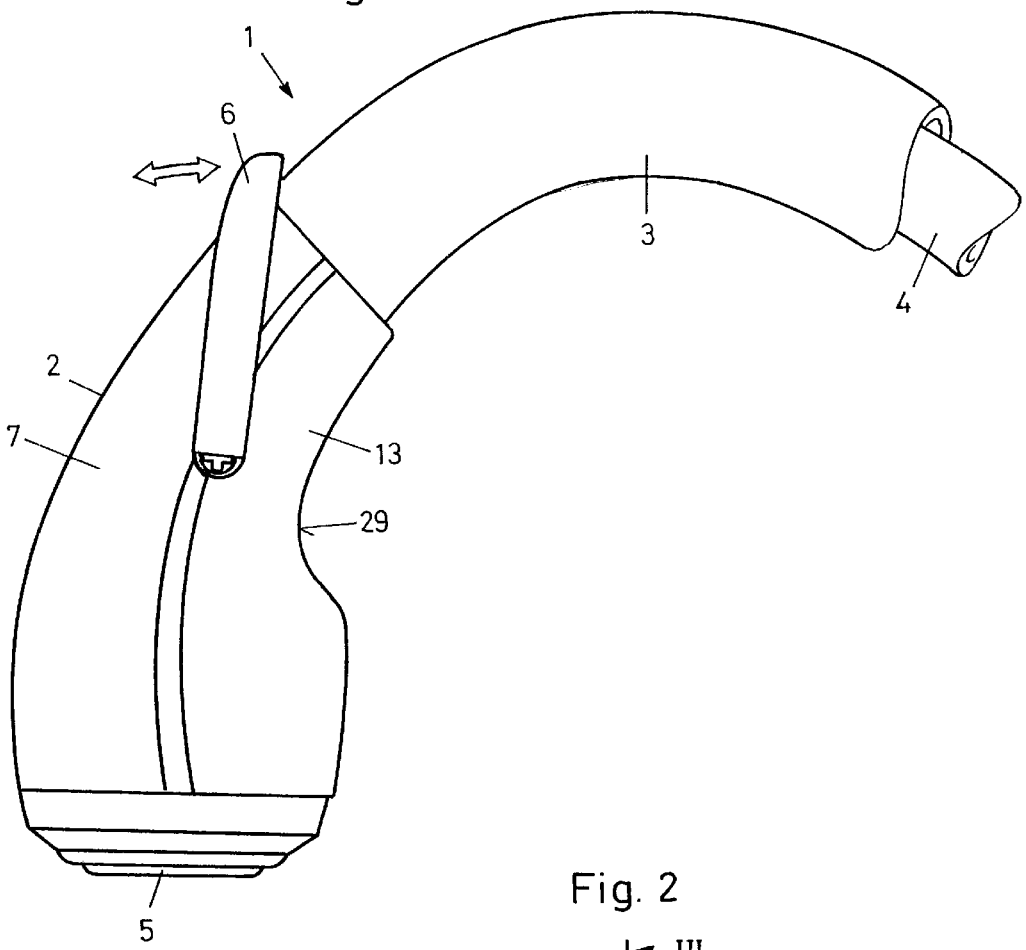
FIG. 1 shows a view of a water discharge device according to the invention, whereby parts of the curved pipe have been omitted.
Figure 2:
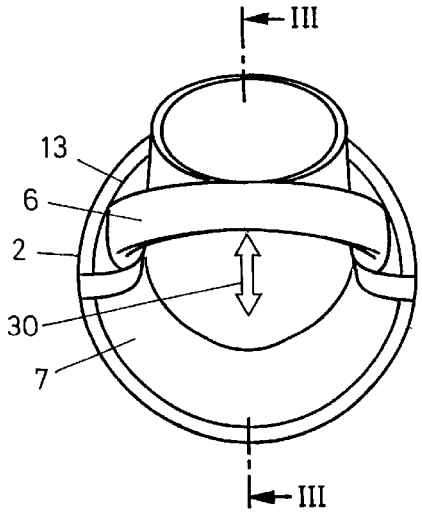
FIG. 2 shows a partial view of the water discharge device according to the invention.
Figure 4:
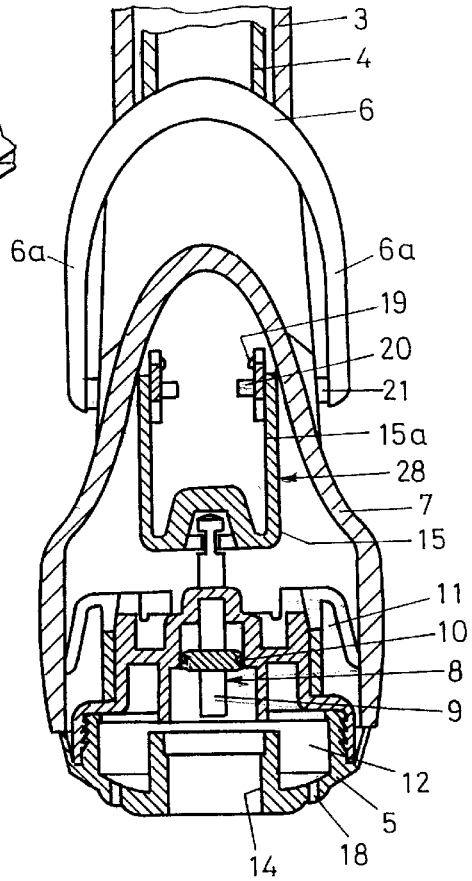
FIG. 4 shows a sectional view along line IV—IV of FIG. 3.

According to FIG. 1, the water discharge device 1 shows a head 2 that has a housing 7 and a housing cover 13, which is clearly pear-shaped and which is thereby considerably smaller at its upper region than in the lower one. A discharge mouthpiece 5 is inserted into the bottom side of the housing 7 whereby said mouthpiece 5 has an opening 14 according to FIG. 4 to receive a screen and which mouthpiece has additionally a plurality of relatively small borings 18 at the circumference for spray discharge. Such discharge mouthpieces 5 are known in the art and do not have to be explained any further.

Figure 3:
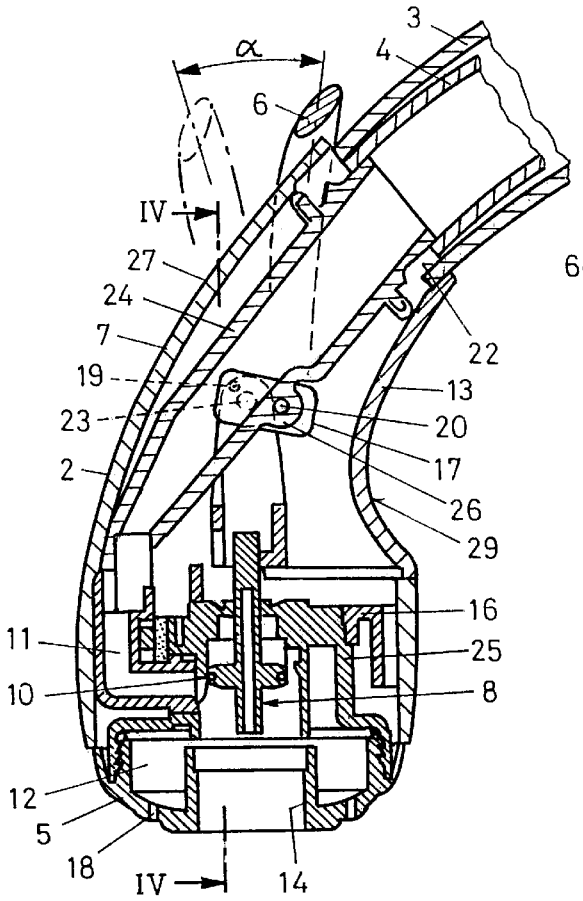
FIG. 3 shows a sectional view along line III—III of FIG. 2.

According to FIG. 3, a tubular water-guiding part 24 is placed into the upper opening 22 of the housing 7 whereby said water-guiding part 24 is connected to a flexible hose 4 that may be pulled out from a curved pipe 3. For example, said curved pipe 3 is mounted on a kitchen sink (not shown) and the hose 4 is connected to a supply line (not shown). A water shut-off valve is additionally arranged at the foot of the curved pipe 3 (not shown) by which the water supply may be turned on or off. The head 2 may be used in the position shown in FIG. 1. However, it may also be grasped with one hand and pulled out of the curved pipe 3 together with the hose 4. The connection to the supply line is maintained and previously unreachable places may be reached with the pulled-out head 2. The hose 4 is connected to pulling means (not shown) whereby it may be retracted to the position shown in FIG. 1 in a very simple manner.

The water-guiding part 24 is connected via a channel 11 to a valve body 25 which is inserted from the bottom into the housing 7 and which is fixed in turn to a holding plate. The above-mentioned discharge mouthpiece 5 is screwed onto the valve body 25. A spindle 30 is provided having a tappet-shaped valve member 9 that has a seal 10 according to FIG. 4 and which may be moved in its longitudinal direction between two positions. In the first position, water flows into a chamber 12 and escapes this chamber through the borings 18. The mentioned spray discharge is created thereby.

Figure 5:
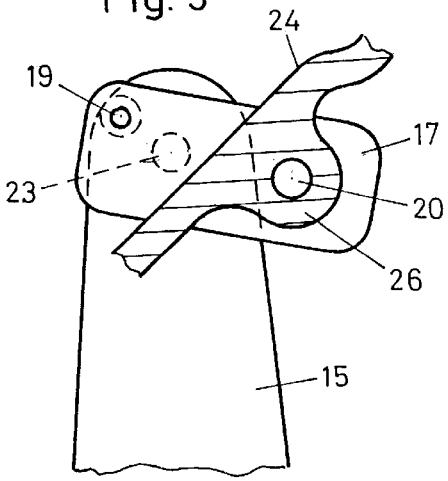
FIG. 5 shows schematically, in an enlarged scale, an illustration of a part of the switching device.

Should the valve member 9 be in the second position (not shown), water flows then through a stream-making device (not shown), which is placed into the opening 14. A so-called central stream discharge is formed thereby. For operation, the valve member 9 is connected to a yoke-shaped crosspiece 15 at its upper end that has two arms 15*a* projecting upwardly thereof. According to FIG. 5, each arm 15*a* is connected to a cam 17 at its upper end via a pivot pin 23 whereby said cam 17 is connected non-rotatably to an axis pin 20 of the bail 6 at a distance to the pin 23. According to FIG. 4, the bail 6 is provided with two pins 20 which protrude inwardly through the housing 2 by means of cross-shaped extensions 21. As shown in FIG. 5, the pins 20 engage a corresponding eye 26 molded onto the water-guiding part 24. The pivot bearing of the bail 6 is thus disposed on the water-guiding part 24. According to FIG. 4, the bail 6 is thereby provided with two pins 20, which project toward the inside and which are rotatably mounted on a projection 21 of the housing 2, respectively. The pins 20 engage a corresponding eye 26 that is molded onto the water-guiding part 24, as it is illustrated in FIG. 5. A catch stop 19 is formed onto each cam 17 at a distance to the pin 23 whereby said catch stop 19 cooperates with the two positions of the water-guiding part 24 (not shown).

The bail 6 is designed roughly U-shaped and it is swivable between the positions indicated in FIG. 3. The pivoting angle, which is identified by the letter "α" in FIG. 3, is preferably smaller than 45 degrees and preferably approximately 20–25 degrees. The optimum angle is about 23 degrees. The pivoting angle α is thereby relatively small. The two catch stops 19 are locked in place in the two end positions shown in FIG. 3. As it can be seen, the bail 6 projects upwardly in the two positions shown in FIG. 3 and it is disposed at the upper area of the face 27 of the housing 2. Should the head 2 be grasped with the hand, then the bail 6 is optimally positioned in the area of the thumb and it may be pivoted forward and backward with the thumb per arrow 30 (FIG. 1). Through this movement, the crosspiece 15 is lifted or lowered over the cam 17 and the valve member 9 is lifted or lowered thereby as well. The switching valve 8 is thereby switched. The cam 17 and the crosspiece 15 form thereby a switching arrangement 28 with which the switching valve 8 may be switched. The illustrated arrangement makes possible the above-mentioned relatively small pivoting angle α. Nevertheless, the device consists of relatively few parts and may be installed in a simple manner.

What is claimed is:

1. A water discharge device having a hose (4) sliding in a curved pipe (3) and a spray head (2) with a discharge mouthpiece (5) that may be pulled downwardly out of said curved pipe (3) whereby a switching valve (8) arranged on said spray head (2) is positioned in a housing (7) that is dimensioned in such a manner that it may be grasped and operated by a user with one hand, and whereby an operating lever (6) projects to an outside thereof by which said switching valve (8) may be actuated, characterized in that the operating lever (6) is a bail that is pivotably mounted and connected to a switching arrangement (28) disposed in said housing (7) with which a valve member (9) of the said switching valve (8) may be moved in its longitudinal direction when the bail is pivoted, whereby said bail (6) is mounted on said housing (7) in such a manner that it may be operated with a thumb of the hand that is grasping said housing (7);

wherein said valve member (9) is configured to be moved by a cam (17) of said switching arrangement (28); and wherein said switching arrangement (28) is provided with a crosspiece (15) that connects said cam (17) to said valve member (9).

2. A water discharge device according to claim 1, wherein said crosspiece (15) has two parts (17) which are joined at one end to a pivoting axis (20) of said cam (6) and which are joined at the other end to said crosspiece (15).

3. A water discharge device according to claim 1, wherein said spray head (2) is pear-shaped having a face (27) and a back side (29), and wherein said bail (6) is mounted at the narrower upper end of said spray head (2).

4. A water discharge device according to claim 1, wherein said bail (6) is locked releasable in two positions.

5. A water discharge device according to claim 1, wherein said bail (6) projects essentially upwardly in its two positions.

6. A water discharge device according to claim 1, wherein said bail (6) has a pivoting angle (α) that is less than 45 degrees, preferably about 20–25 degrees.

7. The water discharge device according to claim 1, wherein said water discharge device is a kitchen spray faucet.

8. The water discharge device according to claim 1, wherein said operating lever is a U-shaped lever.

9. A water discharge device having a hose (4) sliding in a curved pipe (3) and a spray head (2) with a discharge mouthpiece (5) that may be pulled downwardly out of said curved pipe (3) whereby a switching valve (8) arranged on said spray head (2) is positioned in a housing (7) that is dimensioned in such a manner that it may be grasped and operated by a user with one hand, and whereby an operating lever (6) projects to an outside thereof by which said switching valve (8) may be actuated, characterized in that the operating lever (6) is a bail that is pivotably mounted and connected to a switching arrangement (28) disposed in said housing (7) with which a valve member (9) of the said switching valve (8) may be moved in its longitudinal direction when the bail is pivoted, whereby said bail (6) is mounted on said housing (7) in such a manner that it may be operated with a thumb of the hand that is grasping said housing (7);

wherein said bail is locked releasable in two positions; and wherein said bail (6) is locked in place by stop catches (19) which are each attached to a cam (17).

10. The water discharge device according to claim 9, wherein said spray head is pear-shaped having a face and a back side, and wherein said bail is mounted at the narrower upper end of said spray head.

11. The water discharge device according to claim 9, wherein said bail projects essentially upwardly in its two positions.

12. The water discharge device according to claim 9, wherein said bail has a pivoting angle (α) that is less than 45 degrees, preferably about 20–25 degrees.

13. A water discharge device having a hose (4) sliding in a curved pipe (3) and a spray head (2) with a discharge mouthpiece (5) that may be pulled downwardly out of said curved pipe (3) whereby a switching valve (8) arranged on said spray head (2) is positioned in a housing (7) that is dimensioned in such a manner that it may be grasped and operated by a user with one hand, and whereby an operating lever (6) projects to an outside thereof by which said switching valve (8) may be actuated, characterized in that the operating lever (6) is a bail that is pivotably mounted and connected to a switching arrangement (28) disposed in said housing (7) with which a valve member (9) of the said switching valve (8) may be moved in its longitudinal direction when the bail is pivoted, whereby said bail (6) is mounted on said housing (7) in such a manner that it may be operated with a thumb of the hand that is grasping said housing (7);

wherein said bail (6) is pivotably mounted on a water-guiding part (24).

14. The water discharge device according to claim 13, wherein said spray head is pear-shaped having a face and a back side, and wherein said bail is mounted at the narrower upper end of said spray head.

15. The water discharge device according to claim 13, wherein said bail projects essentially upwardly in its two positions.

16. The water discharge device according to claim 13, wherein said bail has a pivoting angle ($\alpha$) that is less than 45 degrees, preferably about 20–25 degrees.

* * * * *